US009177775B2

(12) United States Patent
Hasegawa et al.

(10) Patent No.: US 9,177,775 B2
(45) Date of Patent: Nov. 3, 2015

(54) MASS SPECTROMETER

(71) Applicant: HITACHI HIGH-TECHNOLOGIES CORPORATION, Tokyo (JP)

(72) Inventors: Hideki Hasegawa, Tokyo (JP); Hiroyuki Satake, Tokyo (JP); Masao Suga, Tokyo (JP); Yuichiro Hashimoto, Tokyo (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 0 days.

(21) Appl. No.: 14/371,043

(22) PCT Filed: Dec. 21, 2012

(86) PCT No.: PCT/JP2012/083193

§ 371 (c)(1),
(2) Date: Jul. 8, 2014

(87) PCT Pub. No.: WO2013/111485

PCT Pub. Date: Aug. 1, 2013

(65) Prior Publication Data

US 2015/0001392 A1 Jan. 1, 2015

(30) Foreign Application Priority Data

Jan. 23, 2012 (JP) ..... 2012-010604

(51) Int. Cl.

| | |
|---|---|
| ***H01J 49/04*** | (2006.01) |
| ***H01J 49/24*** | (2006.01) |
| ***H01J 49/06*** | (2006.01) |
| ***H01J 49/26*** | (2006.01) |

(52) U.S. Cl.
CPC ..... *H01J 49/24* (2013.01); *H01J 49/0404* (2013.01); *H01J 49/0431* (2013.01); *H01J 49/062* (2013.01); *H01J 49/26* (2013.01)

(58) Field of Classification Search
USPC ..... 250/281, 282, 288
See application file for complete search history.

(56) References Cited

U.S. PATENT DOCUMENTS

| | | | |
|---|---|---|---|
| 5,756,994 | A | 5/1998 | Bajic |
| 5,986,259 | A | 11/1999 | Hirabayashi et al. |
| 6,380,538 | B1 | 4/2002 | Bajic |
| 6,700,119 | B1 | 3/2004 | Giles |
| 2010/0320374 | A1 | 12/2010 | Jarrell et al. |

FOREIGN PATENT DOCUMENTS

| | | | |
|---|---|---|---|
| JP | 09-068517 | A | 3/1997 |
| JP | 2001-502114 | A | 2/2001 |
| JP | 3201226 | B2 | 6/2001 |
| JP | 2011-505669 | A | 2/2011 |

*Primary Examiner* — Nicole Ippolito
*Assistant Examiner* — Hanway Chang
(74) *Attorney, Agent, or Firm* — Mattingly & Malur, PC

(57) ABSTRACT

An object of the present invention is to prevent lowering of introduction efficiency of ions and to reduce labor for a cleaning operation. In order to solve the above problems, the present invention provides a mass spectrometer where ion introduction hole of an electrode is divided into a first region, a second region, and a third region, a central axis direction of the ion introduction hole in both or either one of the first region and the third region is different from a flow direction axis of the ion inside the ion introduction hole in the second region, and axes of the ion introduction hole in the first region and the third region are in an eccentric position relationship.

8 Claims, 11 Drawing Sheets

MASS SPECTROMETER

TECHNICAL FIELD

The present invention relates to a mass spectrometer, which has high robustness and is capable of high sensitivity analysis.

BACKGROUND ART

A general atmospheric pressure ionization mass spectrometer introduces ions generated under atmospheric pressure into vacuum and analyzes mass of the ion.

An ion source generating ions under atmospheric pressure includes various methods, such as electrospray ionization (ESI), atmospheric pressure chemical ionization (APCI), and matrix assisted laser desorption/ionization (MALDI). However, materials, which becomes noise components other than desirable ions, are generated in any of the methods. For example, in the ESI ion source, while a sample solution is flowed in a metal capillary with a small diameter, a high voltage is applied thereto to ionize the sample. Accordingly, noise components other than the ion, such as charged droplets or neutral droplets, are simultaneously generated.

The general mass spectrometer is divided into several spaces respectively divided by apertures, and each space is exhausted by a vacuum pump. As it goes to a rear stage, degree of vacuum is higher (pressure is lower). A first space divided from atmospheric pressure by a first aperture electrode (AP1) is exhausted by a rotary pump or the like and often held at degree of vacuum of about several hundred Pa. A second space divided from the first space by a second aperture electrode (AP2) has an ion transport unit (a quadrupole electrode, an electrostatic lens electrode, and the like), which transports ions while focusing it, and is often exhausted at about several Pa by a turbomolecular pump or the like. A third space divided from the second space by a third aperture electrode (AP3) includes an ion analysis unit (an ion trap, a quadrupole mass filter, a collision cell, time-of-flight mass spectrometer (TOF), and the like), which performs separation or dissociation of ions, and a detection unit detecting ions. The third space is often exhausted at 0.1 Pa or less by the turbomolecular pump or the like. There is also a mass spectrometer divided into more than three spaces, but a device consisting of about three spaces is generally used.

The generated ions (including a noise component) pass through the AP1 and are introduced into a vacuum chamber. After that, ions pass through the AP2 and are focused on a central axis in the ion transport unit. After that, ions pass through the AP3, and are separated at every mass or dissociated in the ion analysis unit. Accordingly, a structure of the ion can be analyzed in more detail. Eventually, ions are detected by the detection unit.

In the most general mass spectrometer, the AP1, AP2, and AP3 are often disposed coaxially. Since the aforementioned droplet other than the ion is hardly affected by an electric field of the aperture electrode, the transport unit, or the analysis unit, it basically tends to go straight. Because of that, there is a case where a surface or the like of each aperture electrode having a very small diameter is contaminated.

Therefore, in the general mass spectrometer, it becomes necessary to remove and clean the AP1 or the AP2 periodically. However, a vacuum system, such as a vacuum exhaust pump, needs to be stopped for the cleaning, and it generally takes one day or more to stably operate the vacuum system after restarting it. Further, excessive introduction of the droplets, which goes straight, may reach the detector and also leads to shorten a life of the detector.

In order to solve this problem, in PTL 1, a member having a plurality of holes is disposed between an ion source and an AP1. Since no hole is opened in this member at a position coaxial with the AP1, introduction of noise components from the AP1 can be reduced. However, since this member having a plurality of holes is disposed outside the AP1, both front and rear sides of this member are in a state of atmospheric pressure.

On the other hand, in PTL 2 or PTL 3, droplets, which goes straight, are removed by orthogonally disposing an axis of an AP1 outlet and an axis of an AP2. However, a space between the AP1 and the AP2 bent at a right angle is exhausted by a vacuum exhaust pump, such as a rotary pump, in a direction orthogonal to the axis of the AP2.

CITATION LIST

Patent Literature

PTL 1: U.S. Pat. No. 5,986,259
PTL 2: U.S. Pat. No. 5,756,994
PTL 3: U.S. Pat. No. 6,700,119

SUMMARY OF INVENTION

Technical Problem

In a device configuration described in PTL 1, since an outside of the AP1 has atmospheric pressure, a pressure difference between the outside and an inside of the AP1 is large. Because of that, a flow in a vicinity of the AP1 outlet is in a sonic speed state, and may generate a Mach disk. Since the flow in the vicinity of the AP1 outlet is disturbed by the Mach disk, introduction efficiency of ions into the AP2 lowers.

On the other hand, in a device configuration described in PTL 2 or PTL3, the space between the AP1 and the AP2 bent at a right angle is exhausted by the vacuum exhaust pump, such as the rotary pump, in the direction orthogonal to the axis of the AP2. Because of that, ions are also exhausted together with noise components, such as droplets, thereby causing loss of the ion and lowering sensitivity. Further, the axis of the AP1 outlet and the axis of the AP2 are disposed orthogonally. Since they are at positions where a tip of the AP2 is directly seen from a trajectory of the flow, a frequency of contamination may be increased depending on a usage condition or the like. In a case where the AP2 is contaminated, it is necessary to stop a vacuum system and perform a cleaning operation of the AP2.

Solution to Problem

The above-described problem is solved by a mass spectrometer, which introduces ions generated under atmospheric pressure into a vacuum chamber exhausted by vacuum exhausting means and analyzes mass of the ion, having: an electrode, in which ion introduction hole introducing the ion into the vacuum chamber is opened, wherein the ion introduction hole of the electrode is divided into a first region, a second region, and a third region, a central axis direction of the ion introduction hole in both or either one of the first region and the third region is different from a flow direction axis of the ion inside the ion introduction hole in the second region, the second region has no outlet other than outlets leading to the first region and the third region, the electrode can be separated between the first region and the second region or between the third region and the second region or in a midway of the second region, and axes of the ion introduction hole in the first region and the third region are in an eccentric position relationship.

Advantageous Effects of Invention

According to the present invention, the ion introduction unit with high robustness and easy maintenance is realized, and it becomes possible to realize the mass spectrometer with high sensitivity and low noise.

DESCRIPTION OF EMBODIMENTS (Embodiment 1)

In Embodiment 1, description will be given of a configuration in which a hole of a first aperture electrode is divided into three regions, one hole is formed in each of a first region and a third region, and the first aperture electrode can be separated between the first region and a second region.

Figure 1:
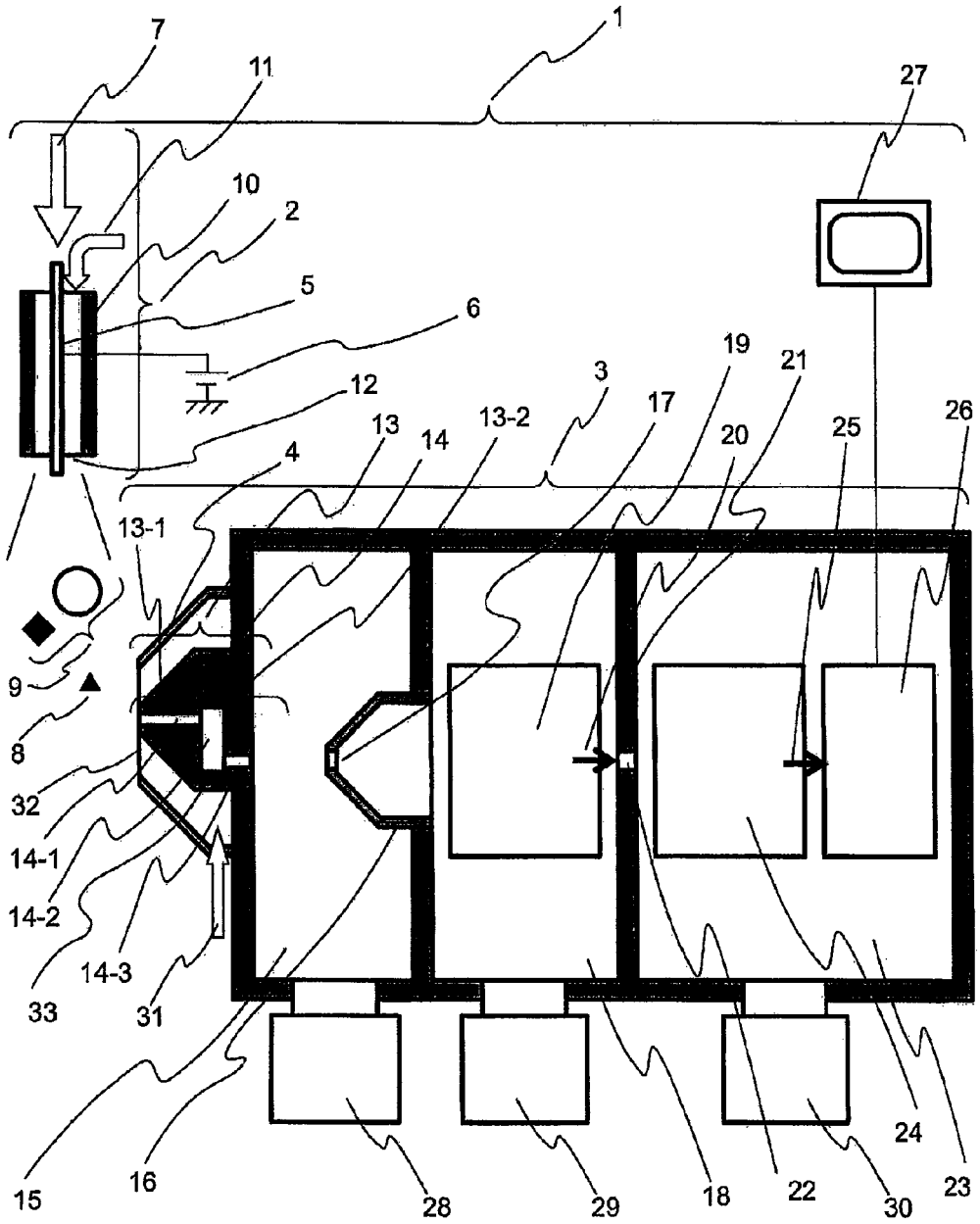
FIG. 1 is a configuration diagram of a device in Embodiment 1.

FIG. 1 illustrates an explanatory diagram of a configuration of a mass spectrometer using a present system.

A mass spectrometer 1 is mainly constituted of an ion source 2 under atmospheric pressure and a vacuum chamber 3. The ion source 2 illustrated in FIG. 1 generates ions of a sample solution by a principle called electrospray ionization (ESI). In the principle of the ESI method, a sample solution 7 is supplied to a metal capillary 5 while a high voltage 6 is applied thereto, thereby generating ions 8 of the sample solution. In a process of the ion generation principle of the ESI method, droplets 9 of the sample solution 7 is repeatedly split, and eventually becomes a very fine droplet and ionized. Droplets incapable of becoming a fine droplet in the process of ionization includes neutral droplets, charged droplets, and the like. In order to reduce these droplets 9, a pipe 10 is provided outside the metal capillary 5, a gas 11 is flowed into a gap therebetween, and the gas 11 is sprayed from an outlet end 12 of the pipe 10. Accordingly, vaporization of the droplet 9 is promoted.

The ion 8 or the droplet 9 generated under the atmospheric pressure is introduced into a hole 14 opened in a first aperture electrode 13. The introduced ions 8 pass through the hole 14 of the first aperture electrode 13 and are introduced into a first vacuum chamber 15. After that, ions 8 pass through a hole 17 opened in a second aperture electrode 16 and are introduced into a second vacuum chamber 18. In the second vacuum chamber 18, there is an ion transport unit 19, which transports ions while focusing it. In the ion transport unit 19, a multipole electrode, an electrostatic lens, and the like can be used. Ions 20 passing through the ion transport unit 19 pass through a hole 22 opened in a third aperture electrode 21 and are introduced into a third vacuum chamber 23. In the third vacuum chamber 23, there is an ion analysis unit 24, which performs separation or dissociation of ions. In the ion analysis unit 24, an ion trap, a quadrupole mass filter, a collision cell, a time-of-flight mass spectrometer (TOF), and the like can be used. Ions 25 passing through the ion analysis unit 24 are detected by a detector 26. In the detector 26, an electron multiplier, a micro-channel plate (MCP), and the like can be used. Ions 25 detected by the detector 26 are converted into an electric signal or the like, and information, such as mass or intensity of the ion, can be analyzed in detail by a control unit 27. Further, the control unit 27 includes an input/output section, a memory, and the like for receiving an instruction input from a user or controlling a voltage or the like. The control unit 27 has software or the like required for a power source operation.

It should be noted that the first vacuum chamber 15 is exhausted by a rotary pump (RP) 28 and held at about several hundred Pa. The second vacuum chamber 18 is exhausted by a turbomolecular pump (TMP) 29 and held at about several Pa. The third vacuum chamber 23 is exhausted by a TMP 30 and held at 0.1 Pa or less. Further, an electrode 4 as illustrated in FIG. 1 is disposed outside the first aperture electrode 13, and a gas 31 is introduced into a gap therebetween and sprayed from an outlet end 32 of the electrode 4. Accordingly, the droplet 9 to be introduced into the vacuum chamber 3 is reduced.

Figure 2:
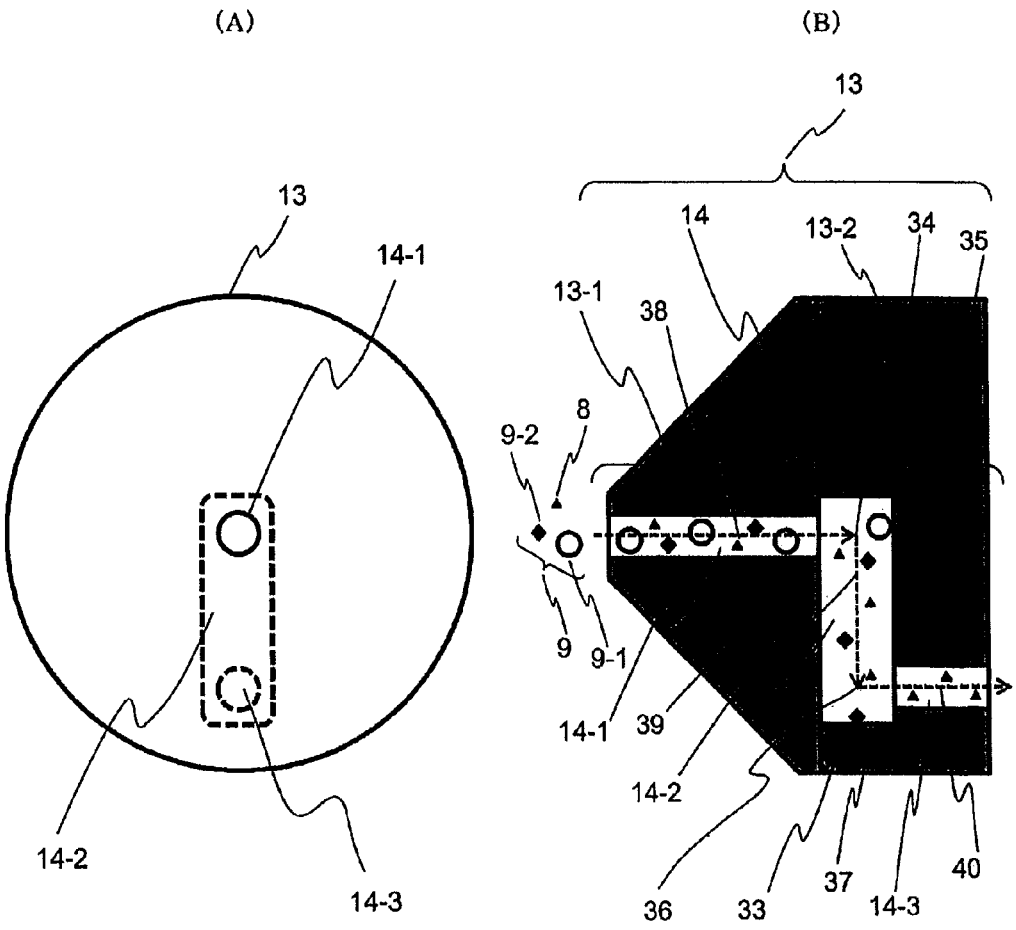
FIG. 2(A) is an explanatory diagram of a first aperture electrode as seen in a direction of an ion source of Embodiment 1.
FIG. 2(B) is an explanatory diagram of a cross section of the first aperture electrode of Embodiment 1 on a central axis.

As illustrated in FIGS. 1, 2(A), and 2(B), the hole 14 of the first aperture electrode 13 of the present system is divided into three regions 14-1 to 14-3. A flow axis 38 of the first region 14-1 and a flow axis 39 of the second region 14-2 are in an orthogonal position relationship, and the flow axis 39 of the second region 14-2 and a flow axis 40 of the third region 14-3 are also in an orthogonal position relationship. It should be noted that since the respective flow axes 38 to 40 indicate central axes of flow within the respective regions 14-1 to 14-3, there may be a case where a location or the like, at which the flows are not exactly orthogonal, exists. Incidentally, in order to obtain the effects of the present invention, it is not necessary for the flow axes to have an exactly orthogonal position relationship. Even in a position relationship close to the orthogonal state, the effects of the present invention can be obtained. Further, the flow axis 38 of the first region 14-1 and the flow axis 40 of the third region 14-3 are in a parallel position relationship where central positions are deviated. It should be noted that since the respective flow axes 38 and 40 indicate central axes of flow within the respective regions 14-1 and 14-3, there may be a case where a location or the like, at which the flows are not exactly parallel, exists. Incidentally, in order to obtain the effects of the present invention, it is not necessary for the flow axes to have an exactly parallel position relationship. Even in a position relationship close to the parallel state, the effects of the present invention can be obtained. Moreover, the second region 14-2 becomes a space having no outlet other than an inlet/outlet to the first region 14-1 or the third region 14-3 by vacuum airtight means, such as an O ring 33.

Next, according to a structure diagram of the first aperture electrode 13 of the present system illustrated in FIGS. 2(A) and 2(B), a principle that separates the introduced ions 8 and droplets 9 and efficiently transports only the ions 8 will be described. FIG. 2(A) illustrates an explanatory diagram of the first aperture electrode 13 as seen in a direction of the ion source 2, and FIG. 2(B) illustrates a cross-sectional view of the first aperture electrode 13 on a central axis.

When droplets 9 or ions 8 are introduced into the hole 14 of the first aperture electrode 13 as illustrated in FIG. 2(B), ions 8 or droplets 9 introduced after passing through a hole of the first region 14-1 is selected according to a size of a particle diameter in the second region 14-2 (particle diameter separation). A relatively large droplet 9-1 (illustrated by a white circle in the diagram) of the droplets 9, which has not been able to be sufficiently miniaturized in the process of ionization, is heavy and has large inertia compared to ions 8 (illustrated by a black triangle in the diagram) or a relatively small droplet 9-2 (illustrated by a black square in the diagram). Consequently, the droplet 9-1 cannot go around a first curve 34, collides with an inner wall surface 35, and is deactivated. In other words, only the small droplet 9-2 or ions 8 can go around the first curve 34. After that, in a second curve 36 as well, because of the large inertia, the droplet 9-2 cannot go around the second curve 36, collides with an inner wall surface 37, and is deactivated. In other words, only ions 8 can go around the second curve 36. Ions 8, which has gone around the second curve 36, passes through a hole of the third region 14-3 and reaches the second aperture electrode 16. In the present system, a direction of the flow axis 39 in the second region 14-2 is in a direction different from a direction of the flow axis 38 in the first region 14-1 and a direction of the flow axis 40 in the third region 14-3 (orthogonal in the diagram). Accordingly, it is possible to perform the particle diameter separation inside the hole 14 of the first aperture electrode 13.

Further, in order to cause the droplet 9 having large inertia to go straight more efficiently and not to curve, it is desirable that introduction of the droplet 9 into the second region 14-2 be jet flow in a high speed state. A condition generating jet flow close to sonic speed is based on an assumption that primary side pressure of a piping is higher than or equal to atmospheric pressure (=100,000 Pa), and secondary side pressure thereof needs to be set at pressure, which is about half or less of the primary side pressure thereof. Accordingly, since primary side pressure of the first region 14-1 of the first aperture electrode 13 is atmospheric pressure, it is found that an inside of the second region 14-2 needs to be set at about its half, i.e., 50,000 Pa or less. By satisfying this condition, it is possible to perform efficient particle diameter separation, and inflow of the noise component, such as the droplet 9, to the first vacuum chamber 15 can be greatly reduced.

Moreover, by setting the pressure of the second region 14-2 at 50,000 Pa or less, introduction efficiency of ions 8 into the hole 17 of the second aperture electrode 16 can be improved. In a case where the atmospheric pressure and the first vacuum chamber are divided as in the conventional method, the flow becomes sonic speed at the outlet of the first aperture electrode. Consequently, Mach disk is generated, and introduction efficiency of the ion into the hole of the second aperture electrode lowers due to disturbance of the flow. On the other hand, in the present system, ions 8, which has pass through the first aperture electrode 13, eventually pass through the hole of the third region 14-3 and enters the first vacuum chamber 15. At this time, since a flow passage of the third region 14-3 on a primary side becomes the second region 14-2, and the primary side (the second region 14-2) pressure is 50,000 Pa or less, the flow cannot be at sonic speed at the outlet of the third region 14-3. Accordingly, in the present system, since the flow cannot be at sonic speed at the outlet of the first aperture electrode 13, turbulence of the flow can be reduced. Therefore, introduction efficiency of ions 8 into the hole 17 of the second aperture electrode 16 can be improved.

Further, the second region 14-2 becomes the space having no outlet other than the inlet/outlet to the first region 14-1 or the third region 14-3 by the vacuum airtight means, such as the O ring 33. Since the second region 14-2 is not particularly exhausted by a vacuum pump or the like, the flow of gas including the ion 8, which has flowed in from the first region 14-1, flows entirely to the third region 14-3. Therefore, loss of the ion or the like caused by the exhaust of the vacuum pump as in the conventional method is greatly reduced, thereby leading to improvement of sensitivity.

Additionally, by having a structure in which a cross-sectional configuration orthogonal to a flow direction of the second region 14-2 is different from a cross-sectional configuration of the first region 14-1 or the third region 14-3, efficiency of ionization can be improved. Actually, as illustrated in FIG. 2(B), by making the cross-sectional configuration of the second region 14-2 larger than that of the first region 14-1 or the third region 14-3, the cross-sectional area becomes large, and the flow speed can be slowed down. Since the flow speed is slowed down, retention time of ions 8 or droplets 9 in the second region 14-2 can be increased. Generally, the first aperture electrode 13 is often used by heating with heating means (not illustrated), such as a heater, and effects, such as desolvation action and acceleration of vaporization inside the first aperture electrode 13, are obtained by the heating. As in the present system, by increasing the retention time inside the first aperture electrode 13, vaporization can be further accelerated. As a result, it is possible to improve the ionization efficiency by the vaporization.

As mentioned above, by using the present system, the inflow of noise components, such as droplets 9, to the first vacuum chamber 15 are reduced, and contamination of electrodes or the like after the second aperture electrode 16 can be greatly decreased. Accordingly, frequency of maintenance of these electrodes or the like can be greatly reduced. However, since there is a concern that the inner wall surface 35 of the first curve 34 and the inner wall surface 37 of the second curve 36 illustrated in FIG. 2(B) are contaminated due to the collision of the droplet 9, periodic maintenance, such as cleaning, is needed.

Therefore, the present system employs a structure capable of separating easily the first aperture electrode 13 into a front stage section 13-1 and a rear stage section 13-2 between the first region 14-1 and the second region 14-2. In the present configuration, even in a case where the front stage section 13-1 of the first aperture electrode 13 is removed and the atmospheric pressure and the first vacuum chamber 15 are substantially divided by only the hole of the third region 14-3, i.e., only the rear stage section 13-2, a size of the hole of the third region 14-3 is set to a degree that the vacuum system including the vacuum pumps, such as the RP 28 or the IMPs 29, 30, is not suffered from damage. By having such a configuration, without stopping the vacuum system, it becomes easy to perform a cleaning operation, such as wiping off dirt on an inner surface of the second region 14-2 by a solvent, such as alcohol, after the first region 14-1 is removed. With this configuration, it is not necessary to stop the vacuum system for every cleaning and to wait for more than one day to stabilize a restarting operation as in the conventional method, and throughput of the device improves.

In a case where it is assumed that the front stage section 13-1 (the first region 14-1) is actually removed without stopping the vacuum system, it is necessary to set the pressure of the second region 14-2 at about 1/10 or more of the atmospheric pressure (=100,000 Pa) in a state in which the front stage section 13-1 is mounted. In other words, in this condition, when a state in which the first region 14-1 exists or a state in which the first region 14-1 does not exist are compared, the former becomes 10,000 Pa or more and the latter becomes the atmospheric pressure (=100,000 Pa), and a pressure fluctuation outside the third region 14-3 can be set at 1/10 or less. Since it is necessary to suppress the pressure fluctuation at about 1/10 to maintain the vacuum system in a sound state, it is desirable that the pressure of the second region 14-2 be set at 10,000 Pa or more. In the general mass spectrometer, each chamber is exhausted by the vacuum pump as in the same manner as the example illustrated in FIG. 1, and there are many cases where the RP 28 to be used in exhaustion of the first vacuum chamber 15 also serve as the vacuum pump for exhausting back pressure of the TMPs 29, 30. The back pressure condition of the TMP operation is about several thousand Pa at most. This value is about ten times with respect to general pressure of several hundred Pa of the first vacuum chamber 15. Through this, it is essential to suppress the pressure fluctuation within ten times.

From the above description, it is desirable that the pressure of the second region 14-2 be used within a range of 10,000 Pa to 50,000 Pa.

Actually, formulae of flow rates and conductance of the first region 14-1 and the third region 14-3 of the first aperture electrode 13 are expressed in the following formulae 1 to 3. Here, Q is a flow rate [Pa*−m$^3$/s], $C_1$, $C_2$ are exhaust conductance [m$^3$/s] of the first region 14-1 and the third region 14-3, $P_1$ is atmospheric pressure [=100,000 Pa], $P_2$ is pressure [Pa] of the second region 14-2, $P_3$ is pressure [Pa] of the first vacuum chamber 15, S is exhaust speed [m$^3$/s] of the RP 28, $D_1$, $D_2$ are inner diameters [m] of the first region 14-1 and the third region 14-3, $L_1$, $L_2$ are lengths [m] of the first region 14-1 and the third region 14-3.

$$Q=C_1(P_1-P_2)=C_2(P_2-P_3)\approx SP_3 \quad \text{(Mathematical Formula 1)}$$

$$C_1=1305*D_1^4/L_1*(P_1+P_2)/2 \quad \text{(Mathematical Formula 2)}$$

$$C_2=1305*D_2^4/L_2*(P_2+P_3)/2 \quad \text{(Mathematical Formula 3)}$$

From the above formulae 1 to 3 and the condition that the pressure $P_2$ of the second region 14-2 is 10,000 Pa to 50,000 Pa, the following formulae 4 and 5 are obtained.

$$D_1^4/L_1=1.55*10^{-13}*SP_3\sim 2.04*10^{-13}*SP_3 \quad \text{(Mathematical Formula 4)}$$

$$D_2^4/L_2\approx 6.13*10^{-13}*SP_3\sim 1.53*10^{-13}*SP_3 \quad \text{(Mathematical Formula 5)}$$

Here, in a case of an example in which the exhaust speed S of the RP28 is 450 L/min (=0.0075 m$^3$/s) and the pressure $P_3$ of the first vacuum chamber 15 is 250 Pa, the following conditional formulae for satisfying $P_2$=10,000 Pa to 50,000 Pa are obtained.

$$D_1^4/L_1=2.91*10^{-13}\sim 3.83*10^{-13} \quad \text{(Mathematical Formula 6)}$$

$$D_2^4/L_2=1.15*10^{-12}\sim 2.87*10^{-11} \quad \text{(Mathematical Formula 7)}$$

By using these conditional formulae, for example, in a case where $L_1$, $L_2$ are 20 mm (=0.02 m), it is found that $D_1$=0.28 to 0.3 mm and $D_2$=0.39 to 0.87 mm. Depending on the exhaust speed of the RP 28, the set pressure of the first vacuum chamber 15, or the length limits of $L_1$, $L_2$, or the like, it is desirable that $D_1$ and $D_2$ be used within the range of $D_1 \leq 1$ mm, $D_2 \leq 1.5$ mm. Hereinabove, in Embodiment 1, description has been given of the configuration in which the hole of the first aperture electrode is divided into the three regions, the one hole is formed in each of the first region and the third region, and the first aperture electrode can be separated between the first region and the second region.

(Embodiment 2)

In Embodiment 2, description will be given of a configuration in which hole of a first aperture electrode is divided into three regions, a plurality of holes is formed in a first region and one hole is formed in a third region, and the first aperture electrode can be separated between the first region and a second region.

Figure 3:
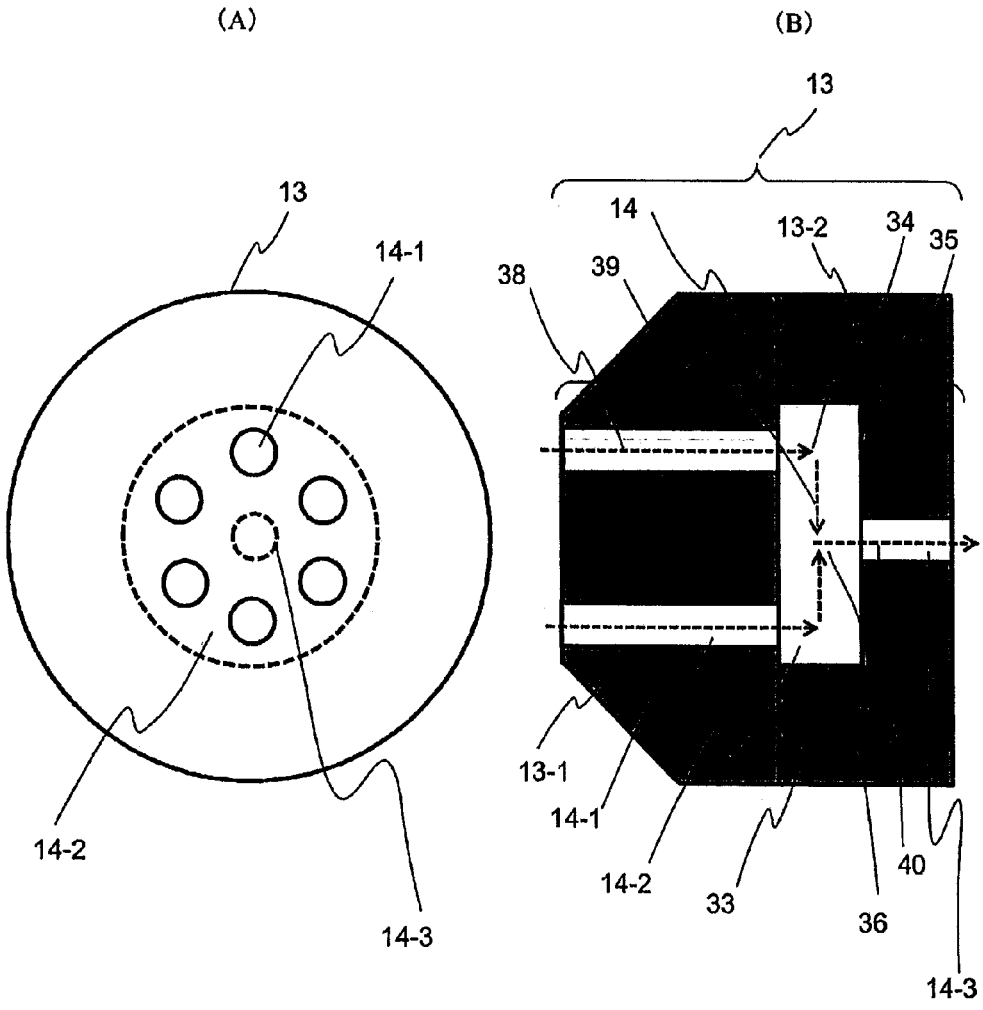
FIG. 3(A) is an explanatory diagram of a first aperture electrode as seen in a direction of an ion source of Embodiment 2.
FIG. 3(B) is an explanatory diagram of a cross section of the first aperture electrode of Embodiment 2 on a central axis.

Description will be given using a configuration diagram of a first aperture electrode 13 of a present system illustrated in FIGS. 3(A) and 3(B). FIG. 3(A) illustrates a diagram of the first aperture electrode 13 as seen in a direction of an ion source 2, and FIG. 3(B) illustrates a cross-sectional view of the first aperture electrode 13 on a central axis. In FIGS. 3(A) and 3(B), the ion 8 and the droplet 9 as illustrated in FIGS. 2(A) and 2(B) are not illustrated for simplicity, but a basic principle is similar to that in FIGS. 2(A) and 2(B).

When droplets 9 or ions 8 are introduced into hole 14 of the first aperture electrode 13 as illustrated in FIG. 3(B), ions 8 or droplets 9 introduced after passing through holes of a first region 14-1 is selected according to a size of a particle diameter in the second region (particle diameter separation). A relatively large droplet 9-1 of the droplets 9, which has not been able to be sufficiently miniaturized in the process of ionization, is heavy and has large inertia compared to ions 8 or a relatively small droplet 9-2. Accordingly, the droplet 9-1 cannot go around a first curve 34, collides with an inner wall surface 35, and is deactivated. In other words, only the small droplet 9-2 or ions 8 can go around the first curve 34. After that, ions 8, which has gone around a second curve 36, passes through a hole of a third region 14-3 and reaches a second aperture electrode 16. It should be noted that in the present system, there is no inner wall surface around the second curve 36, with which droplets collides, but a certain degree of particle diameter separation is performed. In the present system, a direction of a flow axis 39 in a second region 14-2 is in a direction different from a direction of a flow axis 38 in the first region 14-1 and a direction of a flow axis 40 in the third region 14-3 (orthogonal in the diagram). Accordingly, it is possible to perform the particle diameter separation inside the hole 14 of the first aperture electrode 13.

Further, as with FIG. 2(B), the present system also has a structure in which the first aperture electrode 13 can be easily separated into a front stage section 13-1 and a rear stage section 13-2 between the first region 14-1 and the second region 14-2.

Incidentally, it is possible to combine the configuration of the first aperture electrode 13 of the present system with the device configuration illustrated in FIG. 1.

Hereinabove, in Embodiment 2, description has been given of the structure in which the hole of the first aperture electrode is divided into the three regions, the plurality of holes is formed in the first region and the one hole is formed in the third region, and the first aperture electrode can be separated between the first region and the second region.

(Embodiment 3)

In Embodiment 3, description will be given of a configuration in which hole of a first aperture electrode is divided into three regions, one hole is formed in a first region and a plurality of holes is formed in a third region, and the first aperture electrode can be separated between the first region and a second region.

Figure 4:
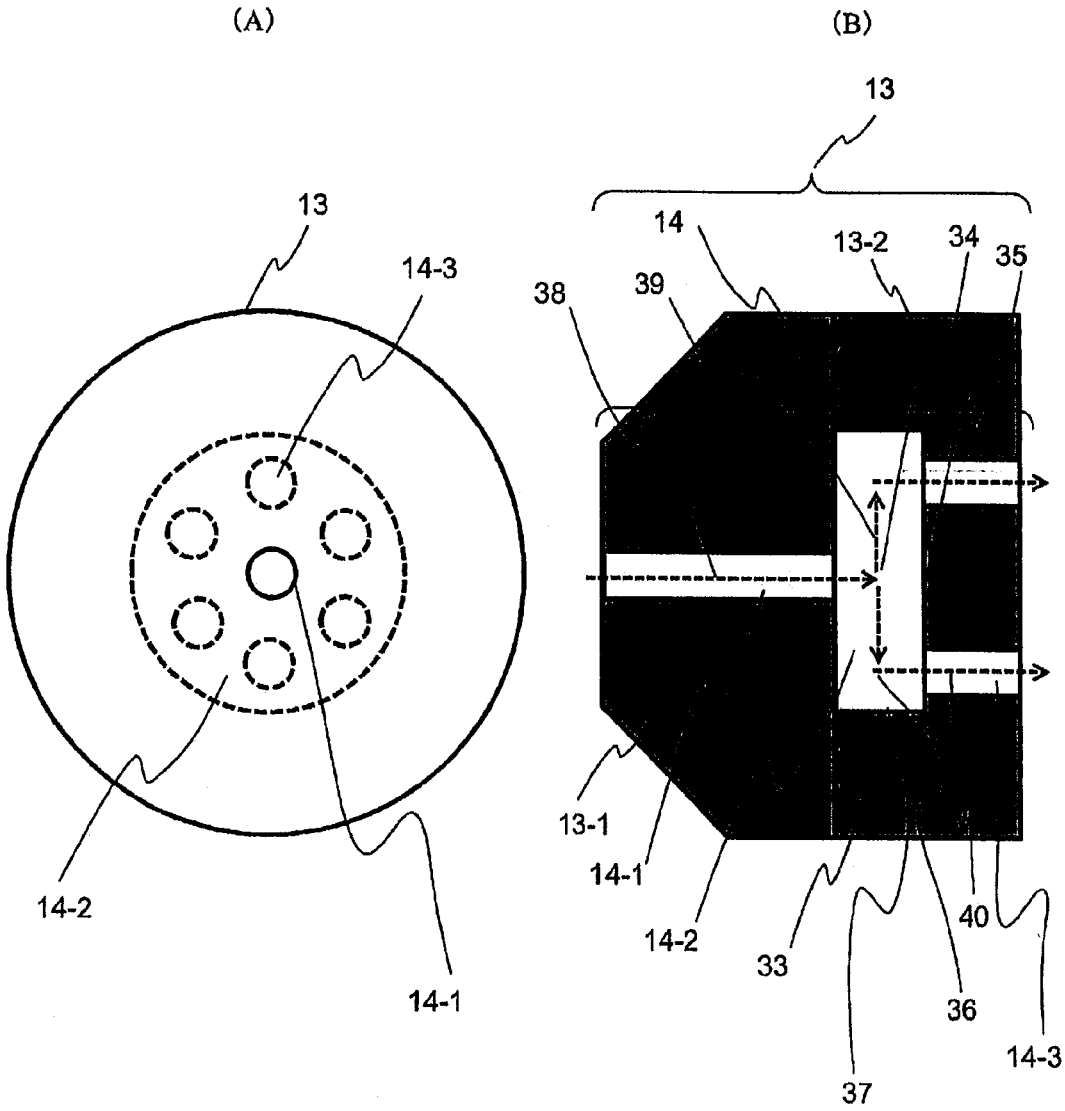
FIG. 4(A) is an explanatory diagram of a first aperture electrode as seen in a direction of an ion source of Embodiment 3.
FIG. 4(B) is an explanatory diagram of a cross section of the first aperture electrode of Embodiment 3 on a central axis.

Description will be given using a configuration diagram of a first aperture electrode 13 of a present system illustrated in FIGS. 4(A) and 4(B). FIG. 4(A) illustrates a diagram of the first aperture electrode 13 as seen in a direction of an ion source 2, and FIG. 4(B) illustrates a cross-sectional view of the first aperture electrode 13 on a central axis. In FIGS. 4(A) and 4(B), the ion 8 and the droplet 9 as illustrated in FIGS. 2(A) and 2(B) are not illustrated for simplicity, but a basic principle is similar to that in FIGS. 2(A) and 2(B).

When droplets 9 or ions 8 are introduced into hole 14 of the first aperture electrode 13 as illustrated in FIG. 4(B), ions 8 or droplets 9 introduced after passing through a hole of a first region 14-1 is selected according to a size of a particle diameter in a second region (particle diameter separation). A relatively large droplet 9-1 of the droplets 9, which has not been able to be sufficiently miniaturized in the process of ionization, is heavy and has large inertia compared to ions 8 or a relatively small droplet 9-2. Accordingly, the droplet 9-1 cannot go around a first curve 34, collides with an inner wall surface 35, and is deactivated. In other words, only the small droplet 9-2 or ions 8 can go around the first curve 34. After that, in a second curve 36 as well, because of the large inertia, the droplet 9-2 cannot go around the second curve 36, collides with an inner wall surface 37, and is deactivated. In other words, only ions 8 can go around the second curve 36. Ions 8, which has gone around a second curve 36, pass through holes of a third region 14-3 and reaches a second aperture electrode 16. In the present system, a direction of a flow axis 39 in a second region 14-2 is in a direction different from a direction of a flow axis 38 in the first region 14-1 and a direction of a flow axis 40 in the third region 14-3 (orthogonal in the diagram). Accordingly, it is possible to perform the particle diameter separation inside the hole 14 of the first aperture electrode 13.

Further, as with FIG. 2(B), the present system also has a structure in which the first aperture electrode 13 can be easily separated into a front stage section 13-1 and a rear stage section 13-2 between the first region 14-1 and the second region 14-2.

Incidentally, it is possible to combine the configuration of the first aperture electrode 13 of the present system with the device configuration illustrated in FIG. 1.

Hereinabove, in Embodiment 3, description has been given of the configuration in which the hole of the first aperture electrode is divided into the three regions, the one hole is formed in the first region and the plurality of holes is formed in the third region, and the first aperture electrode can be separated between the first region and the second region.

Hereinabove, in Embodiments 2 and 3, description has been given of the configuration in which the plurality of holes is formed in the first region or the third region. However, it is possible to have a configuration in which the plurality of holes is formed in both the first region and the third region.

(Embodiment 4)

In Embodiment 4, a configuration in which an ion focus unit is disposed in a first vacuum chamber will be described.

Figure 5:
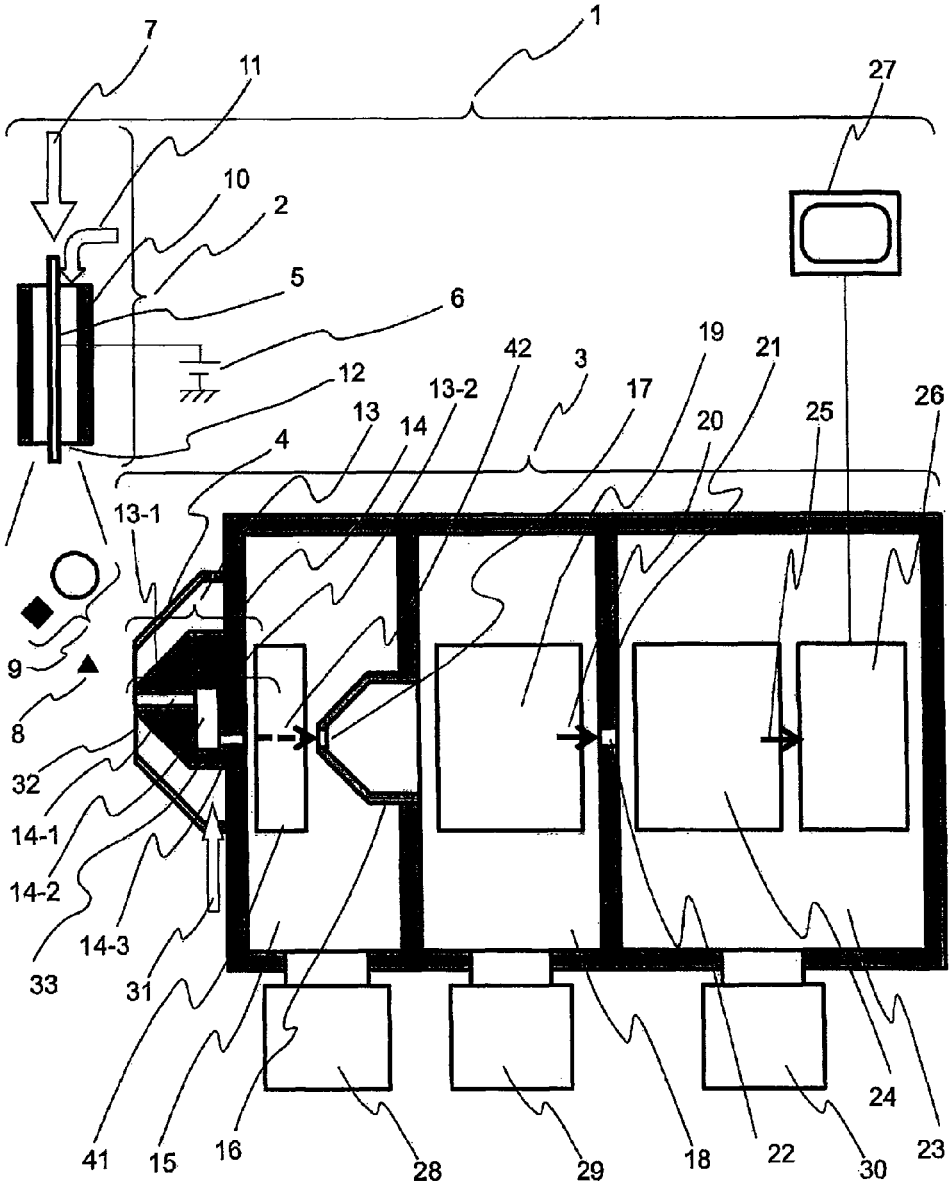
FIG. 5 is a configuration diagram of a device in Embodiment 4.

FIG. 5 illustrates an explanatory diagram of a configuration of amass spectrometer using the present system. In FIG. 5, an ion focus unit 41 is disposed in a first vacuum chamber 15. Other than that, the configuration is substantially the same as that of Embodiment 1 (FIG. 1). Accordingly, only the difference between FIG. 1 and FIG. 5 will be described.

Ions 8 passed through a first aperture electrode 13 are focused on a central axis 42 by the ion focus unit 41, and are introduced into a hole 17 of a second aperture electrode 16. Since ions 8 are positionally focused on the central axis 42, introduction efficiency of ions 8 into the hole 17 of the second aperture electrode 16 improves, and sensitivity enhances. The other configuration is similar to that in FIG. 1.

Incidentally, it is also possible to combine the configuration having the ion focus unit 41 of the present system with the first aperture electrode 13 illustrated in FIGS. 3(A) and 3(B) or FIGS. 4(A) and 4(B)

Hereinabove, in Embodiment 4, the configuration in which the ion focus unit is disposed in the first vacuum chamber has been described.

(Embodiment 5)

In Embodiment 5, description will be given of a configuration in which hole of a first aperture electrode is divided into three regions, one hole is formed in each of a first region and a third region, and the first aperture electrode can be separated between a second region and the third region.

Description will be given using a configuration diagram of a first aperture electrode 13 of a present system illustrated in FIG. 6. Since a basic principle is similar to that in FIGS. 2(A) and 2(B), detailed description thereof will be omitted.

Figure 6:
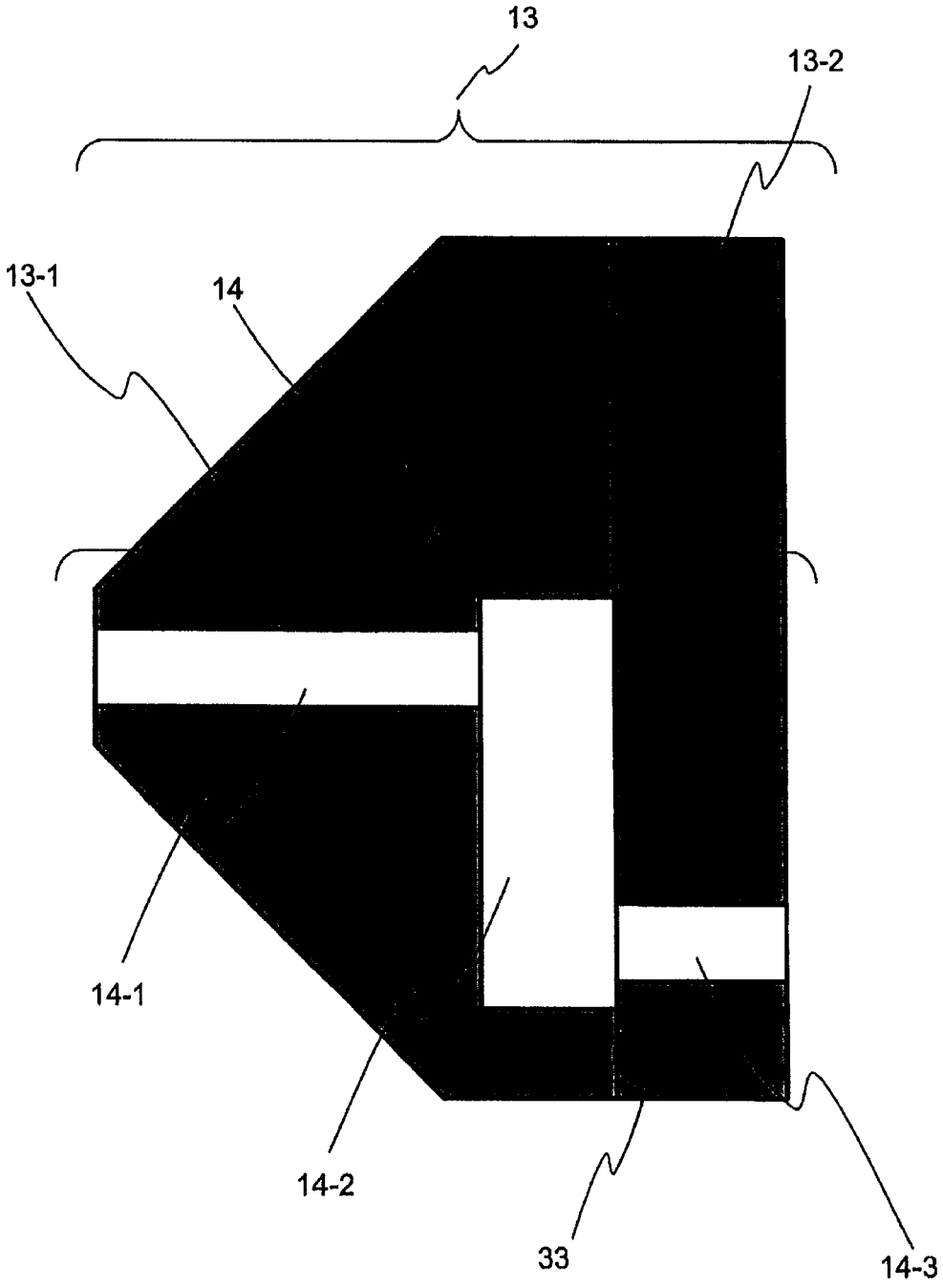
FIG. 6 is an explanatory diagram of a first aperture electrode in Embodiment 5.

The configuration in FIG. 6 has a structure in which the first aperture electrode 13 can be easily separated into a front stage section 13-1 and a rear stage section 13-2 between the second region 14-2 and the third region 14-3. Effects of the separation are similar to those of Embodiment 1. Without stopping a vacuum system, a cleaning operation, such as wiping off dirt on an inner surface of the second region 14-2 by a solvent, such as alcohol, can be performed after the first region 14-1 and the second region 14-2 are removed. With this configuration, it is not necessary to stop the vacuum system for every cleaning and to wait for more than one day to stabilize a restarting operation as in the conventional method, and throughput of the device improves.

Incidentally, it is also possible to combine the configuration of the first aperture electrode 13 of the present system with either of the device configuration illustrated in FIG. 1 or FIG. 5. Further, the separation system of the first aperture electrode 13 of the present system can be combined with the configuration of the first aperture electrode 13 illustrated in FIGS. 3(A) and 3(B) or FIGS. 4(A) and 4(B).

Hereinabove, in Embodiment 5, description has been given of the configuration in which the hole of the first aperture electrode is divided into the three regions, the one hole is formed in each of the first region and the third region, and the first aperture electrode can be separated between the second region and the third region.

(Embodiment 6)

In Embodiment 6, description will be given of a configuration in which a hole of a first aperture electrode is divided into three regions, one hole is formed in each of a first region and a third region, and the first aperture electrode can be separated in a midway of a second region.

Description will be given using a configuration diagram of a first aperture electrode 13 of a present system illustrated in FIG. 7. Since a basic principle is similar to that in FIGS. 2(A) and 2(B), detailed description thereof will be omitted.

Figure 7:
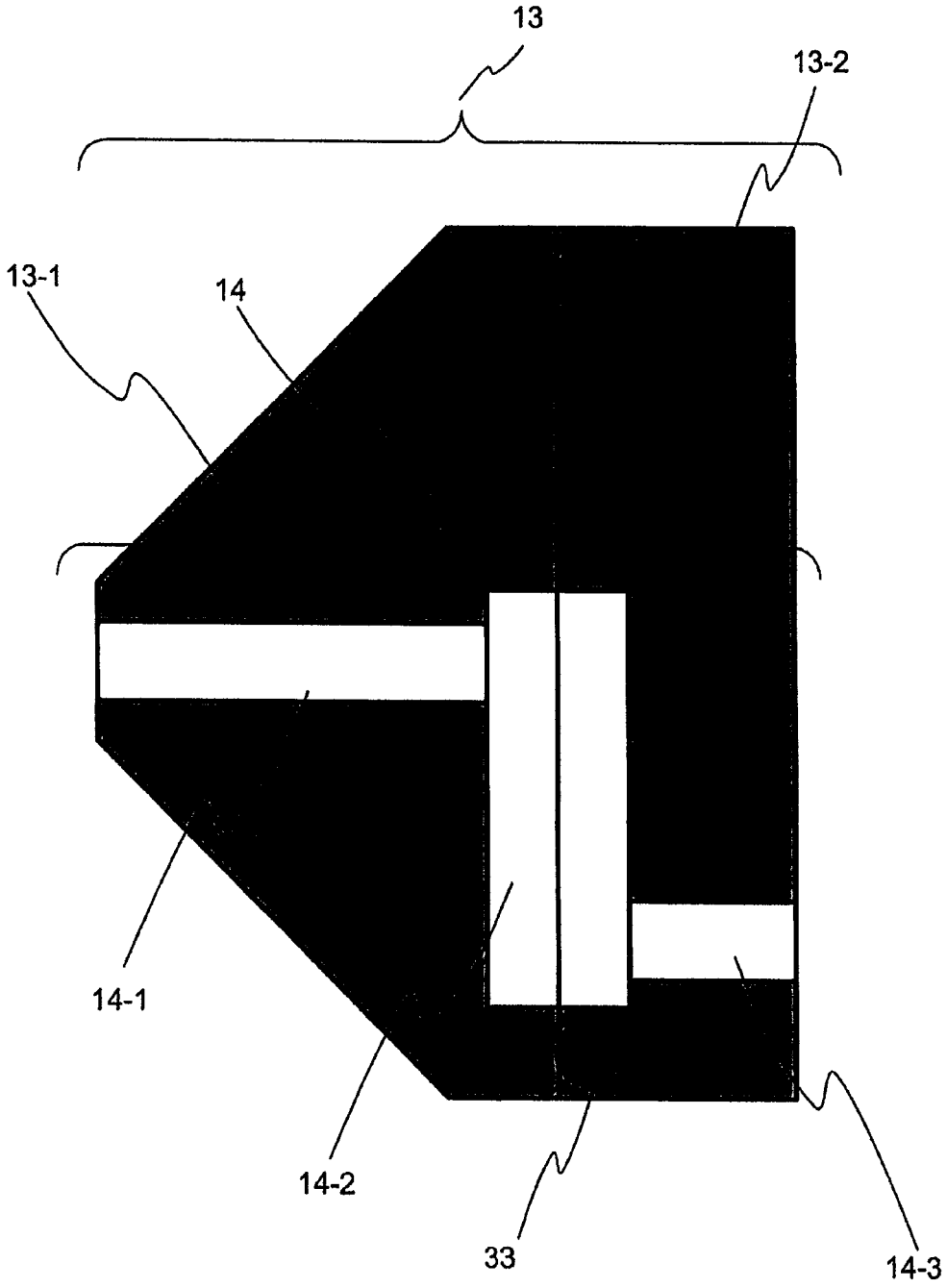
FIG. 7 is an explanatory diagram of a first aperture electrode in Embodiment 6.

The configuration in FIG. 7 has a structure in which the first aperture electrode 13 can be easily separated into a front stage section 13-1 and a rear stage section 13-2 in the midway of a second region 14-2. Effects of the separation are similar to those in Embodiment 1. Without stopping the vacuum system, after a first region 14-1 and the second region 14-2 are removed in the midway of the second region 14-2, it is possible to perform a cleaning operation, such as wiping off dirt on an inner surface of the second region 14-2 by a solvent, such as alcohol. With this configuration, it is not necessary to stop the vacuum system for every cleaning and to wait for more than one day to stabilize a restarting operation as in the conventional method, and throughput of the device improves.

Incidentally, it is also possible to combine the configuration of the first aperture electrode 13 of the present system with either of the device configuration illustrated in FIG. 1 or FIG. 5. Further, the separation system of the first aperture electrode 13 of the present system can be combined with the configuration of the first aperture electrode 13 illustrated in FIGS. 3(A) and 3(B) or FIGS. 4(A) and 4(B).

Hereinabove, in Embodiment 6, description has been given of the configuration in which the hole of a first aperture electrode is divided into the three regions, the one hole is formed in each of the first region and the third region, and the first aperture electrode can be separated in the midway of the second region.

(Embodiment 7)

In Embodiment 7, description will be given of a configuration in which hole of a first aperture electrode is divided into three regions, one hole is formed in each of a first region and a third region, and the first aperture electrode can be separated between the first region and a second region and between the second region and the third region.

Description will be given using a configuration diagram of a first aperture electrode 13 of a present system illustrated in FIG. 8. Since a basic principle is similar to that in FIGS. 2(A) and 2(B), detailed description thereof will be omitted.

Figure 8:
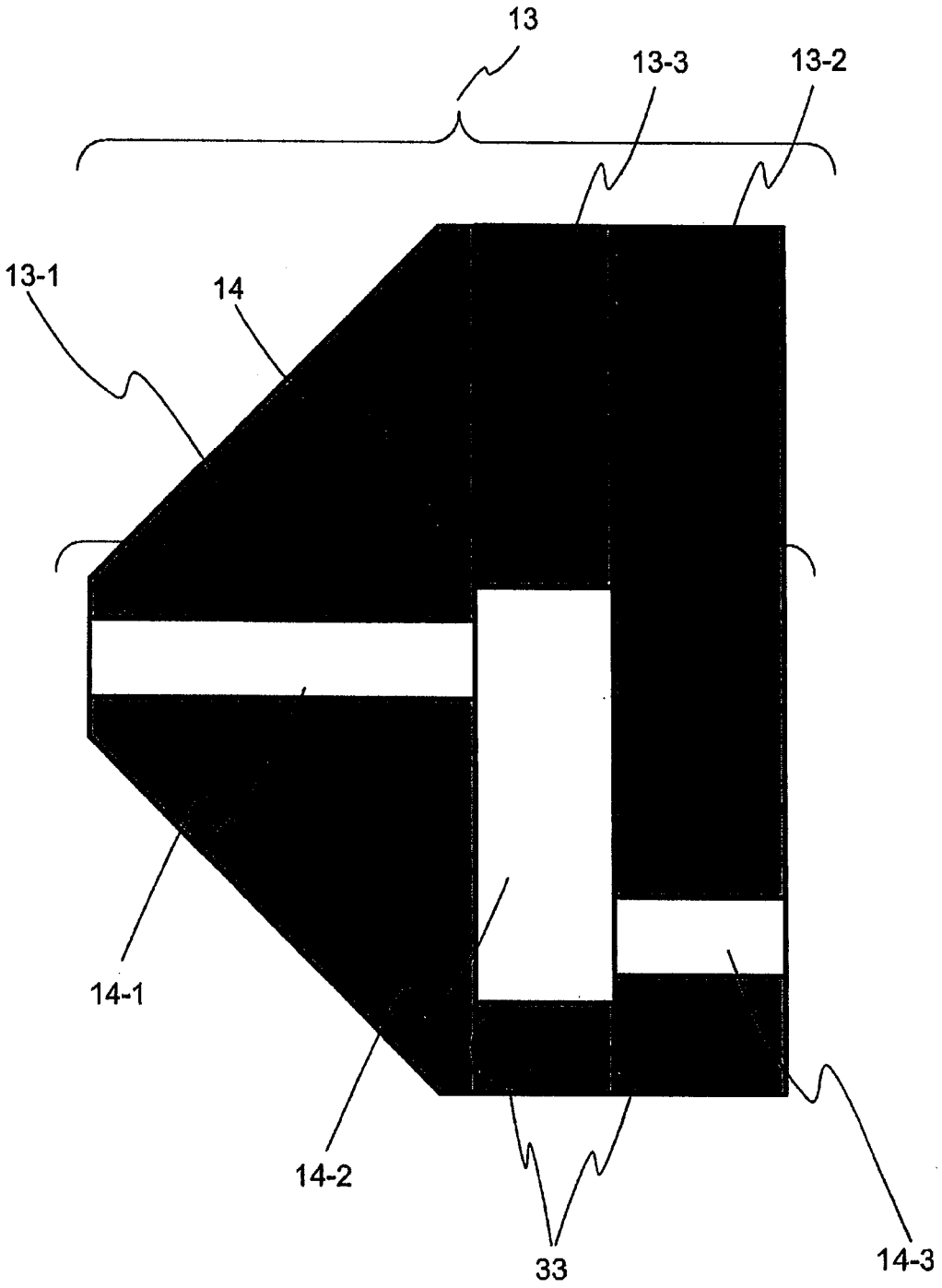
FIG. 8 is an explanatory diagram of a first aperture electrode in Embodiment 7.

The configuration in FIG. 8 has a structure in which the first aperture electrode 13 can be easily separated into a front stage section 13-1, an intermediate stage section 13-3, and a rear stage section 13-2 between a first region 14-1 and a second region 14-2 and between the second region 14-2 and a third region 14-3. Effects of the separation are similar to those of Embodiment 1. Without stopping a vacuum system, a cleaning operation, such as wiping off dirt on an inner surface of the second region 14-2 by a solvent, such as alcohol, can be performed after the first region 14-1 and the second region 14-2 are removed. With this configuration, it is not necessary to stop the vacuum system for every cleaning and to wait for more than one day to stabilize a restarting operation as in the conventional method, and throughput of the device improves.

Incidentally, it is also possible to combine the configuration of the first aperture electrode 13 of the present system with either of the device configuration illustrated in FIG. 1 or FIG. 5. Further, the separation system of the first aperture electrode 13 of the present system can be combined with the configuration of the first aperture electrode 13 illustrated in FIGS. 3(A) and 3(B) or FIGS. 4(A) and 4(B).

Hereinabove, in Embodiment 7, description has been given of the structure in which the hole of the first aperture electrode is divided into the three regions, the one hole is formed in each of the first region and the third region, and the first aperture electrode can be separated between the first region and the second region and between the second region and the third region.

Hereinabove, in Embodiments 5 to 7, the separation of the first aperture electrode different from that in Embodiment 1 has been described. Besides these, it is also possible to have a configuration in which the first aperture electrode is separated in the midway of the first region and the third region, and the configuration has similar effects. However, since the hole at the separated location is relatively small, the cleaning operation or the like can be somewhat difficult.

(Embodiment 8)

In Embodiment 8, description will be given of a configuration in which hole of a first aperture electrode is divided into three regions, one hole is formed in each of a first region and a third region, the first aperture electrode can be separated between the first region and a second region, and the first region is disposed diagonally.

Figure 9:
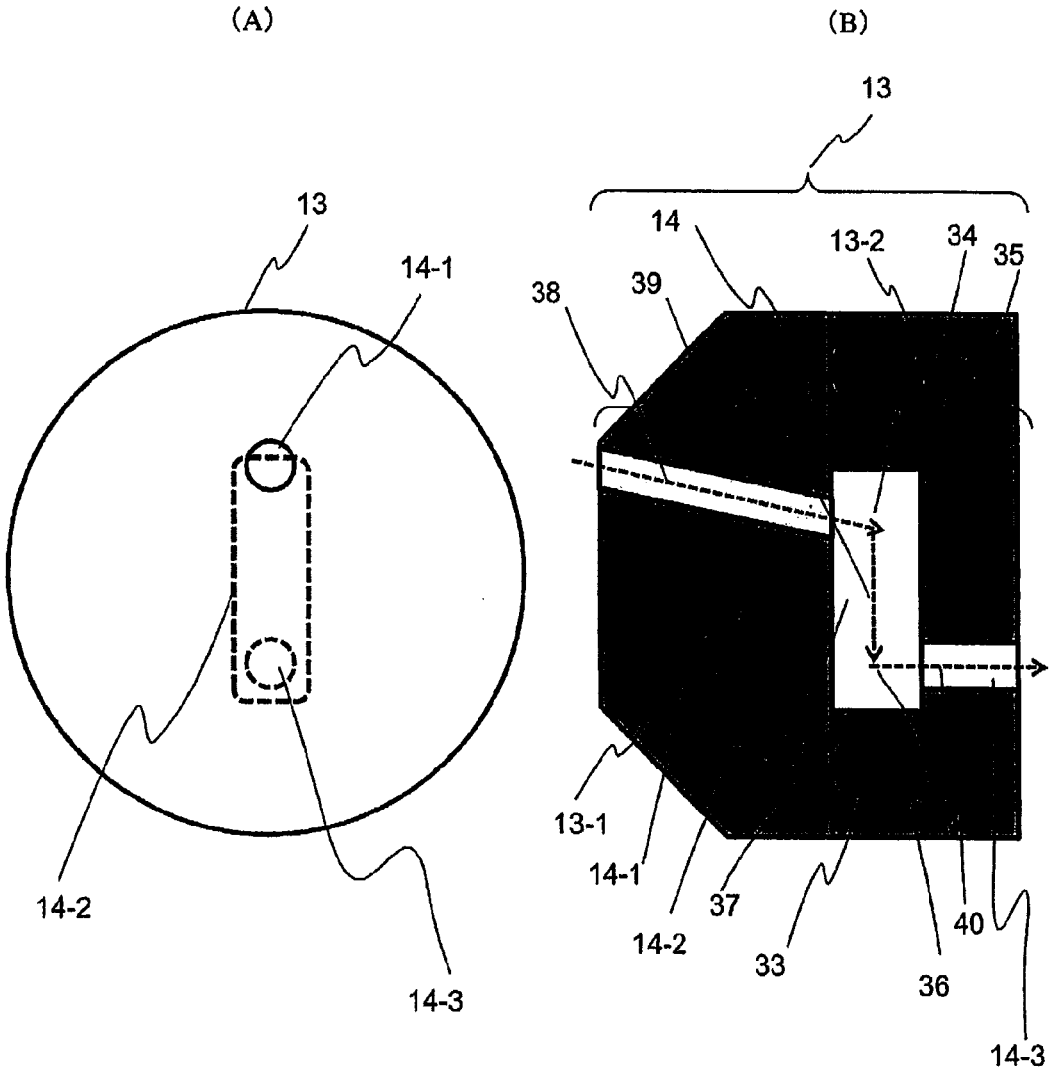
FIG. 9(A) is an explanatory diagram of a first aperture electrode as seen in a direction of an ion source of Embodiment 8.
FIG. 9(B) is an explanatory diagram of a cross section of the first aperture electrode of Embodiment 8 on a central axis.

Description will be given using a configuration diagram of a first aperture electrode 13 of a present system illustrated in FIGS. 9(A) and 9(B). Since a basic principle is similar to that in FIGS. 2(A) and 2(B), detailed description thereof will be omitted. FIG. 9(A) is a diagram of the first aperture electrode 13 as seen in a direction of an ion source 2, and FIG. 9(B) illustrates a cross-sectional view of the first aperture electrode 13 on a central axis.

In the configuration of FIG. 9(B), a flow axis 38 of a first region 14-1 is disposed diagonally to a flow axis 40 of a third region 14-3. In Embodiments so far, each has a configuration in which the flow axis 38 of the first region 14-1 is substantially parallel to the flow axis 40 of the third region 14-3 and is substantially orthogonal to the flow axis 39 of the second region 14-2. However, effects similar to those of previous Embodiments can be obtained even by the device configuration illustrated in FIGS. 9(A) and 9(B).

Incidentally, it is also possible to combine the configuration of the first aperture electrode 13 of the present system with either of the device configuration illustrated in FIG. 1 or FIG. 5. Further, the configuration of the first aperture electrode 13 of the present system can be combined with the configuration of the first aperture electrode 13 illustrated in FIGS. 3(A) and 3(B) or FIGS. 4(A) and 4(B). Moreover, the configuration of the first aperture electrode 13 of the present system can be combined with the separation system of the first aperture electrode 13 illustrated in FIGS. 6, 7, and 8.

Hereinabove, in Embodiment 8, description has been given of the configuration in which the hole of the first aperture electrode is divided into the three regions, the one hole is formed in each of the first region and the third region, the first aperture electrode can be separated between the first region and the second region, and the first region is disposed diagonally.

(Embodiment 9)

In Embodiment 9, description will be given of a structure in which hole of a first aperture electrode is divided into three regions, one hole is formed in each of a first region and a third region, the first aperture electrode can be divided between the first region and a second region, and the third region is disposed diagonally.

Figure 10:
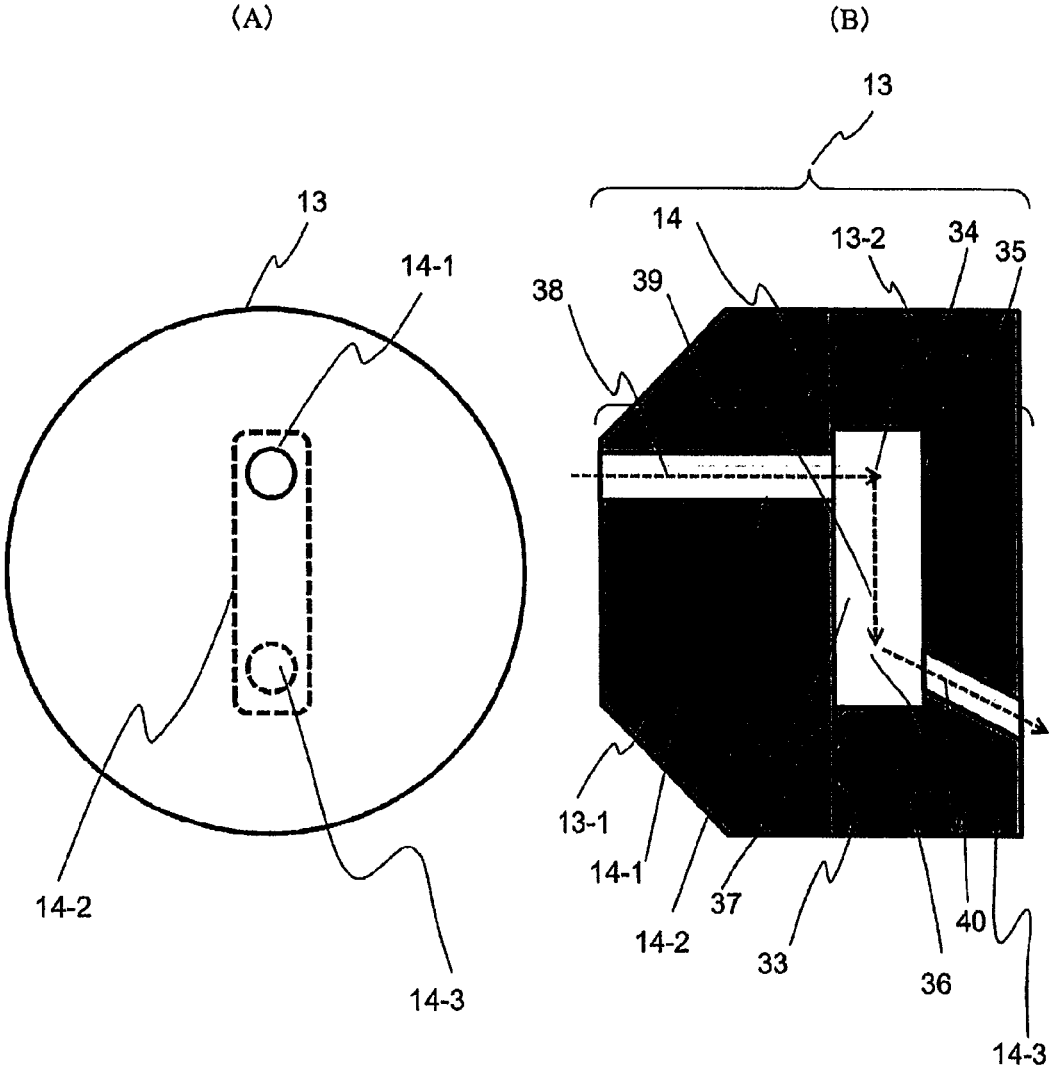
FIG. 10(A) is an explanatory diagram of a first aperture electrode as seen in a direction of an ion source of Embodiment 9.
FIG. 10(B) is an explanatory diagram of a cross section of the first aperture electrode of Embodiment 9 on a central axis.

Description will be given using a configuration diagram of a first aperture electrode 13 of a present system illustrated in FIGS. 10(A) and 10(B). Since a basic principle is similar to that in FIGS. 2(A) and 2(B), detailed description thereof will be omitted. FIG. 10(A) is a diagram of the first aperture electrode 13 as seen in a direction of an ion source 2, and FIG. 10(B) illustrates a cross-sectional view of the first aperture electrode 13 on a central axis.

In the configuration of FIG. 10(B), a flow axis 40 of a third region 14-3 is disposed diagonally to a flow axis 38 of a first region 14-1. In Embodiments so far, each has a configuration in which the flow axis 40 of the third region 14-3 is substantially parallel to the flow axis 38 of the first region 14-1 and is substantially orthogonal to the flow axis 39 of the second region 14-2. However, effects similar to those of previous Embodiments can be obtained even by the device configuration illustrated in FIGS. 10(A) and 10(B).

Incidentally, it is also possible to combine the configuration of the first aperture electrode 13 of the present system with either of the device configuration illustrated in FIG. 1 or FIG. 5. Further, the configuration of the first aperture electrode 13 of the present system can be combined with the configuration of the first aperture electrode 13 illustrated in FIGS. 3(A) and 3(B) or FIGS. 4(A) and 4(B). Moreover, the configuration of the first aperture electrode 13 of the present system can be combined with the separation system of the first aperture electrode 13 illustrated in FIGS. 6, 7, and 8.

Hereinabove, in Embodiment 9, description has been given of the configuration in which the hole of the first aperture electrode is divided into the three regions, the one hole is formed in each of the first region and the third region, the first aperture electrode can be separated between the first region and the second region, and the third region is disposed diagonally.

Hereinabove, in Embodiments 8 and 9, description has been given of the configuration in which the flow axis of the first region or the third region is disposed diagonally. However, it is also possible to have a configuration in which the both flow axes may be disposed diagonally to the second region. Further, the flow axis may be disposed diagonally in a direction different from the direction illustrated in FIG. 9(B) or 10(B). Moreover, it is also possible to dispose the second region diagonally, but a structure can be slightly complicated.

(Embodiment 10)

In Embodiment 10, description will be given of a configuration in which hole of a first aperture electrode is divided into three regions, one hole is formed in each of a first region and a third region, the first aperture electrode can be separated between the first region and a second region, and a deflection electrode is disposed within the second region.

Description will be given using a configuration diagram of a first aperture electrode 13 of a present system illustrated in FIG. 11. Since a basic principle is similar to that in FIGS. 2(A) and 2(B), detailed description thereof will be omitted.

Figure 11:
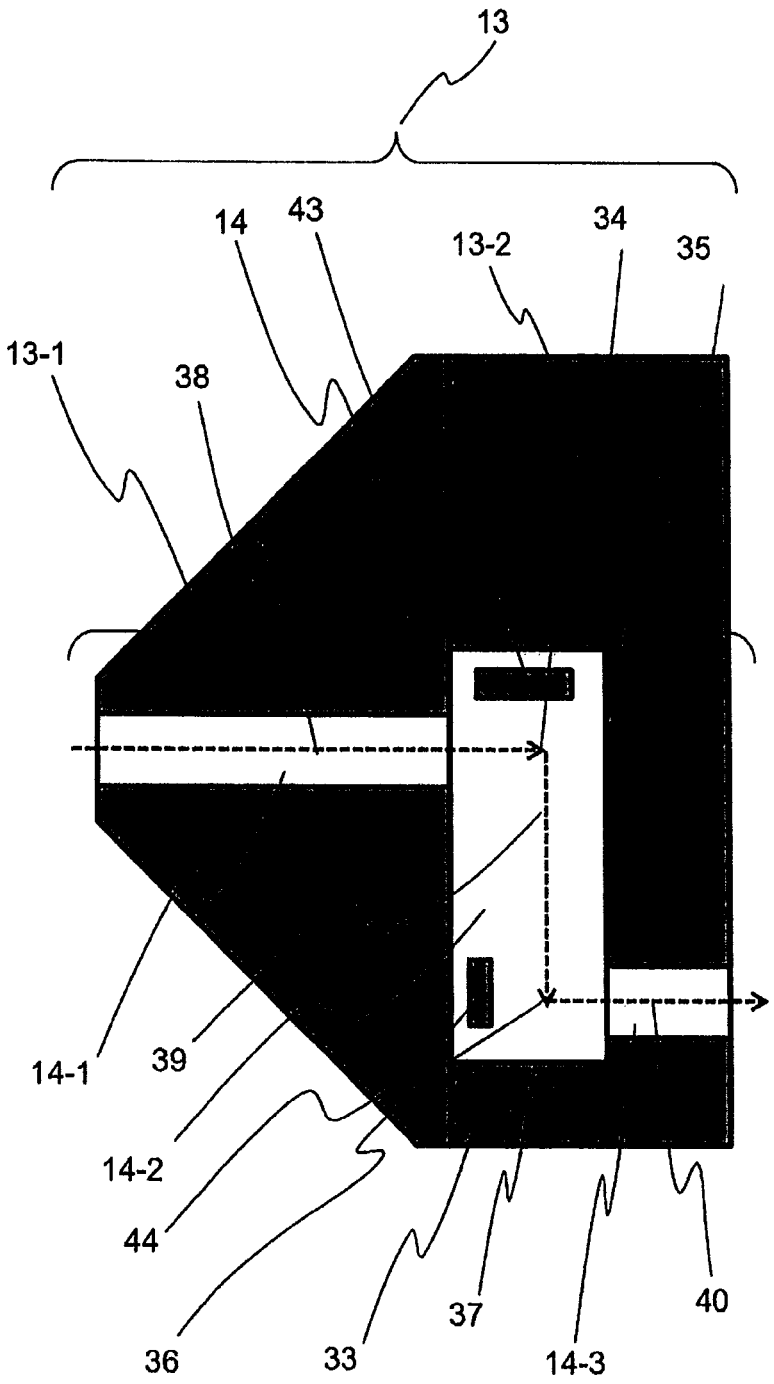
FIG. 11 is an explanatory diagram of a first aperture electrode in Embodiment 10.

In the configuration of FIG. 11, a deflection electrode 43 is disposed in a vicinity of a first curve 34 and a deflection electrode 44 is disposed in a vicinity of a second curve 36 inside a second region 14-2. By applying voltage to the deflection electrodes 43, 44, ions 8 can be curved efficiently. In a case where the ion 8 is a positive ion, the voltage applied to the deflection electrodes 43, 44 is a positive voltage, and in a case where the ion 8 is a negative ion, the voltage applied thereto is a negative voltage. It should be noted that only one of the deflection electrodes 43, 44 may be disposed.

Incidentally, it is also possible to combine the configuration of the first aperture electrode 13 of the present system with either of the device configuration illustrated in FIG. 1 or FIG. 5. Further, the configuration of the first aperture electrode 13 of the present system can be combined with the configuration of the first aperture electrode 13 illustrated in FIGS. 3(A) and 3(B), FIGS. 4(A) and 4(B), FIGS. 9(A) and 9(B), or FIGS. 10(A) and 10(B). Moreover, the configuration of the first aperture electrode 13 of the present system can be combined with the separation system of the first aperture electrode 13 illustrated in FIGS. 6, 7, and 8.

Hereinabove, in Embodiment 10, description has been given of the configuration in which the hole of the first aperture electrode is divided into the three regions, the one hole is formed in each of the first region and the third region, the first aperture electrode can be separated between the first region and the second region, and the deflection electrode is disposed within the second region.

REFERENCE SIGNS LIST

1 mass spectrometer
2 ion source
3 vacuum chamber
4 electrode
5 metal capillary
6 high voltage
7 sample solution
8 ion
9 droplet
9-1 large droplet
9-2 small droplet
10 pipe
11 gas
12 outlet end of pipe
13 first aperture electrode
13-1 front stage section of first aperture electrode
13-2 rear stage section of first aperture electrode
13-3 intermediate stage section of first aperture electrode
14 hole of first aperture electrode
14-1 first region of hole of first aperture electrode
14-2 second region of hole of first aperture electrode
14-3 third region of hole of first aperture electrode
15 first vacuum chamber
16 second aperture electrode
17 hole of second aperture electrode
18 second vacuum chamber
19 ion transport unit
20 ion
21 third aperture electrode
22 hole of third aperture electrode
23 third vacuum chamber
24 ion analysis unit
25 ion
26 detector
27 control unit
28 rotary pump (RP)
29 turbomolecular pump (TMP)
30 turbomolecular pump (TMP)
31 gas
32 outlet end of electrode
33 O ring
34 first curve
35 inner wall surface
36 second curve
37 inner wall surface
38 flow axis of first region
39 flow axis of second region
40 flow axis of third region
41 ion focus unit
42 on central axis
43 deflection electrode
44 deflection electrode

The invention claimed is:

1. A mass spectrometer, which introduces ions generated under atmospheric pressure into a vacuum chamber exhausted by vacuum exhausting means and analyzes a mass of the ion, comprising: an electrode, in which ion introduction hole introducing the ion into the vacuum chamber is opened, wherein the ion introduction hole of the electrode is divided into a first region, a second region, and a third region, a central axis direction of the ion introduction hole in both or either one of the first region and the third region is different from a flow direction axis of the ion inside the ion introduction hole in the second region, the second region has no outlet other than outlets leading to the first region and the third region, the electrode can be separated between the first region and the second region or between the third region and the second region or in a midway of the second region, and axes of the ion introduction hole in the first region and the third region are in an eccentric position relationship.

2. The mass spectrometer according to claim 1, wherein a hole diameter of the ion introduction hole in the third region is 1.5 mm or less.

3. The mass spectrometer according to claim 1, wherein pressure inside the second region is within a range of 10,000 Pa or more to 50,000 Pa or less.

4. The mass spectrometer according to claim 1, wherein a hole diameter of the ion introduction hole in the first region is 1 mm or less.

5. The mass spectrometer according to claim 1, wherein a cross-sectional configuration of the ion introduction hole in both or either one of the first region and the third region is different from a cross-sectional configuration of the ion introduction hole in the second region.

6. The mass spectrometer according to claim 1, wherein the first region has a plurality of ion introduction holes.

7. The mass spectrometer according to claim 1, wherein the third region has a plurality of ion introduction holes.

8. The mass spectrometer according to claim 1, further comprising an ion focus electrode focusing the ion, wherein the third region is disposed between the second region and the ion focus electrode.

* * * * *